US006082602A

United States Patent [19]

Gschwind

[11] Patent Number: 6,082,602

[45] Date of Patent: Jul. 4, 2000

[54] MULTI-USE BELT WITH BALL HOLDER

[76] Inventor: Donata Marialuisa Gianesi Gschwind, Gsteigstrasse 17, CH-8703 Erlenbach, Switzerland

[21] Appl. No.: 08/970,463

[22] Filed: Nov. 14, 1997

Related U.S. Application Data

[63] Continuation-in-part of application No. 08/582,091, Jan. 2, 1996, Pat. No. 5,842,621.

[51] Int. Cl.[7] ..... A45F 3/00

[52] U.S. Cl. ..... 224/682; 224/665; 224/666; 224/247; 224/248; 224/901.8; 224/918; 224/919; 224/251; 224/223

[58] Field of Search ..... 224/919, 918, 224/666, 669, 668, 901.8, 678, 250, 251, 248, 247, 665, 660, 682, 223; 206/315.9

[56] References Cited

U.S. PATENT DOCUMENTS

| | | | |
|---|---|---|---|
| 1,610,344 | 12/1926 | Williams | 224/919 |
| 2,558,382 | 6/1951 | Preuidi | 224/918 |
| 2,618,419 | 11/1952 | Vanish | 224/666 |
| 2,708,061 | 5/1955 | Kotchka | 224/919 |
| 3,753,519 | 8/1973 | Gammon | 224/918 |
| 4,061,256 | 12/1977 | Beer et al. | 224/919 |
| 4,065,040 | 12/1977 | Steere | 224/919 |
| 4,069,954 | 1/1978 | Rauch | 224/918 |
| 4,129,237 | 12/1978 | Grinder | 224/918 |
| 4,836,427 | 6/1989 | McManus | 224/919 |
| 5,031,812 | 7/1991 | Gustine | 224/918 |
| 5,240,156 | 8/1993 | Sicotte et al. | 224/901.8 |
| 5,386,906 | 2/1995 | Lai | 224/919 |
| 5,517,696 | 5/1996 | Krugler | 224/918 |

FOREIGN PATENT DOCUMENTS

| | | | |
|---|---|---|---|
| 5329239 | 12/1993 | Japan | 206/315.9 |

*Primary Examiner*—Linda J. Sholl
*Attorney, Agent, or Firm*—Ian F. Burns

[57] ABSTRACT

A multi-use belt that is designed to be used during sporting activities as well as in social environments. A carrying element and a ball holder may be attached to the belt. The carrying element is adapted to hold instruments for use in a sporting activity. The instruments are held horizontally so that sharp edges do not poke or irritate the user. The ball holder comprises at least one elastic ring that is formed from a helical spring. The carrying element and the ball holder hold objects close to the user's center of mass and the objects are firmly held so that there is little or no relative motion between the objects and the user.

13 Claims, 2 Drawing Sheets

MULTI-USE BELT WITH BALL HOLDER

CROSS REFERENCE TO RELATED APPLICATIONS

This application is a continuation-in-part of application Ser. No. 08/582,091 that was filed on Jan. 2, 1996, now U.S. Pat. No. 5,842,621.

BACKGROUND OF THE INVENTION

1. Field of Invention

The present invention relates to a multi-use belt and ball holder that may be used by golfers.

2. Description of Related Art

Sport belts, belts that are used in sporting activities, are well known in the art. Examples of sports belts can be found in U.S. Pat. No. 4,836,427 issued to McManus and U.S. Pat. No. 5,240,156 issued to Sicotte et al. These devices provide a belt with holders for carrying sporting equipment, such as balls or water bottles. Equipment holders for holding objects during a sporting activity are known in the art. Examples of these devices can be found in Japanese patent number 5-329239 and U.S. Pat. Nos. 1,610,344 issued to Williams, 2,558,382 issued to Previdi, 2,708,061 issued to Kotchka, 3,753,519 issued to Gammon, 4,061,256 to Beer et al., 4,065,040 issued to Steere, 4,069,954 issued to Rauch, 4,129,237 issued to Grinder, and 5,517,696 issued to Krugler.

However, it has been found that these devices do not adequately meet the needs of most golfers. In the game of golf, the swing is the most important aspect of a player's game. If a player cannot execute a proper swing, the player cannot achieve a good score. To this end, it is important that the player not be distracted by objects placed on the player's body and that such objects do not interfere with the motion of the player's swing. Yet equipment holders in the prior art are distracting to golfers and interfere with golf swings. Equipment holders such as those found in Williams, Previdi, and Gammon are not firmly attached to the golfer but hang from a point on the golfer thereby allowing relative movement between the equipment holder and the golfer. This allows the holders and equipment to swing in a pendulous motion. Other holders, such as those found in Beer et al., Rauch, and Krugler, attach to extremities of the golfer, consequently shifting the golfer's center of mass and disturbing the golfer's balance. Finally, other devices, such as Kotchka, Steere, and Grinder have a taller vertical height than most belts and poke the user when the user swings a golf club or bends to pick up a ball.

Another aspect of golf that is important to most golfers is the appearance of golf equipment. Golf tends to be a stylish form of recreation in which appearance and social interaction are important. Most golfers enjoy socializing with other golfers before and after a round of golf. This socializing may take place in a country club, restaurant, or bar where it would be inappropriate to wear sporting equipment. For this reason, golf clothing must be adaptable to different environments and the golfer must be able to remove golf equipment easily. The sport belts in McManus and Sicotti et al. do not meet this need. These belts would not be suitable for use in most social situations and most of the equipment holders disclosed in the above-cited references cannot be easily removed as they require the user to remove a belt from the user's clothes.

SUMMARY OF INVENTION

1. Objects of the Invention

It is therefore an object of the present invention to provide a multi-use belt that may be used by golfers before, during, and after play.

It is a further object of the present invention to provide a multi-use belt that is attractive and unobtrusive in social situations.

It is another object of the present invention to provide a multi-use belt that may have a variety of instruments attached to it.

It is another object of the present invention to provide a multi-use belt that is capable of holding instruments so that the instruments do not swing or move relative to the user.

It is another object of the present invention to provide a multi-use belt that is capable of holding instruments close to the user's center of gravity.

It is a further object of the present invention to provide a multi-use belt that is adaptable to different environments and may be worn with clothing that is customarily worn by golfers.

It is a further object of the present invention to provide a ball holder.

It is a further object of the present invention to provide a ball holder that holds a ball firmly yet allows a user to easily remove a ball.

It is still another object of the present invention to provide a ball holder that utilizes at least one helical spring that is formed into an elastic ring.

It is yet another object of the present invention to provide a ball holder and carrying element that may be operated by a single hand and may be used by left and right handed people.

These and other objects of the present invention may be realized by reference to the remaining portions of the specification, claims, and abstract.

2. Brief Description of the Invention

The present invention comprises a belt, a ball holder, and a carrying element. The belt is designed to appear to be a standard belt that may be worn with standard clothing. The belt may be threaded through belt loops on pants and shorts and it has an attractive appearance that allows the user to wear the belt in most social situations.

The ball holder of present invention comprises at least one elastic ring that is formed from a helical spring. The elastic ring is formed by attaching the ends of a helical spring together. Preferably, but not necessarily, two elastic rings are used and the rings are attached together by at least one strap. The strap may include a stiffening element that stiffens and supports the strap. The ball holder may also comprise a U-shaped clip for removeably attaching the holder to the belt.

The carrying element of the present invention comprises a base portion and at least one pocket portion for holding equipment. Preferably, two pocket portions are provided for holding golf tees and a divot repair tool. The golf tees and the divot repair tool are held horizontally so that sharp edges on the instruments do not poke or irritate the user when the user has attached the carrying element to the belt. The average vertical height of the carrying element is substantially equal to or less than the vertical height of the belt.

A marker, such as a snap button, may be attached to either pocket portion or the base portion. The base portion may comprise a hook and loop fastening material for removeably attaching the carrying instrument to the belt.

The present invention holds instruments firmly so that relative motion between the user and the instruments is minimized. The present invention also holds instruments as close as possible to the user's center of mass. This minimizes the adverse affect of variations in weight distribution.

The above description sets forth, rather broadly, the more important features of the present invention so that the detailed description of the preferred embodiment which follows may be better understood and contributions of the present invention to the art may be better appreciated. There are, of course, additional features of the invention that will be described below and which will form the subject matter of claims. In this respect, before explaining at least one preferred embodiment of the invention in detail, it is to be understood that the invention is not limited in its application to the details of the construction and to the arrangement of the components set forth in the following description or as illustrated in the drawings. The invention is capable of other embodiments and of being practiced and carried out in various ways. Also, it is to be understood that the phraseology and terminology employed herein are for the purpose of description and should not be regarded as limiting.

REFERENCE NUMERALS

Figure 1:
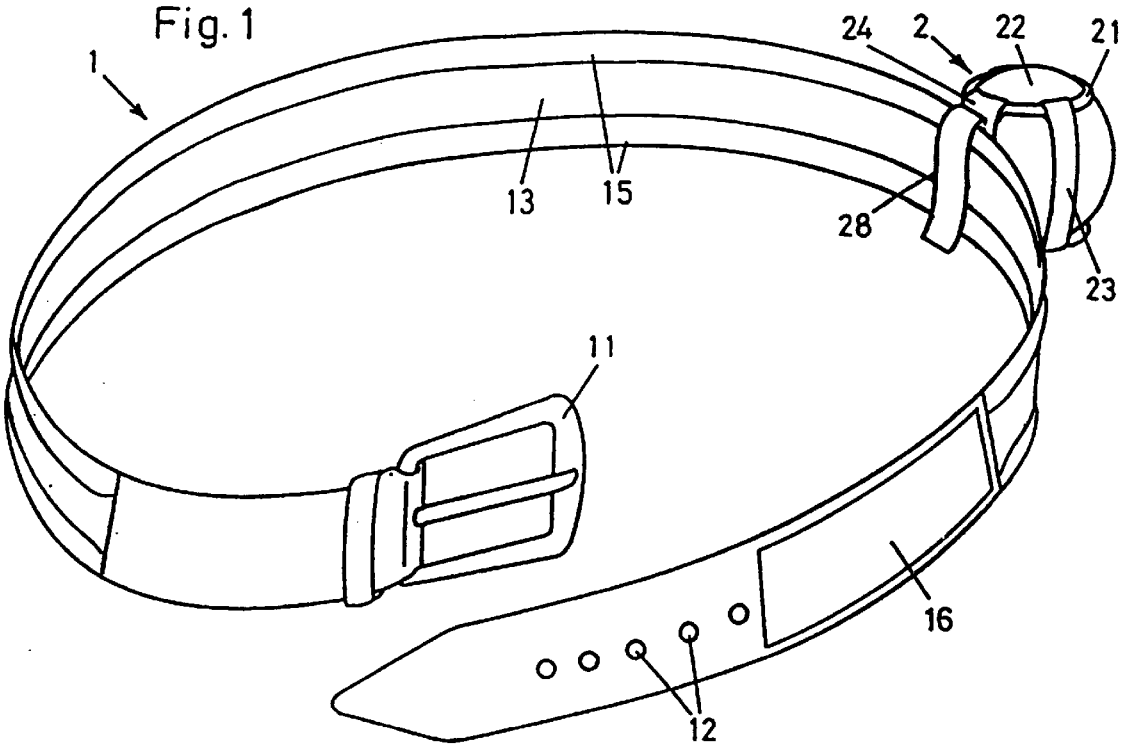
FIG. 1 is substantially a perspective view of the belt of the present invention with a ball holder attached.

1 belt
2 ball holder
3 carrying element
11 buckle
12 holes
13 leather strap
14 cushioning material
15 outer edges
16 hook and loop fastening material
21 helical springs
21*a* spring end
21*b* spring end
22 golf ball
23 strap
24 strap
25 stiffening members
26 slit
27 clip end
28 clip
29 rivet
31 base portion
32 pocket portion
33 pocket portion
34 divot repair tool
35 marker
36 stitching
37 golf tees
38 hook and loop fastening material
40 spring
50 pencil holder
52 pencil

DESCRIPTION OF THE PREFERRED EMBODIMENT

Figure 2:
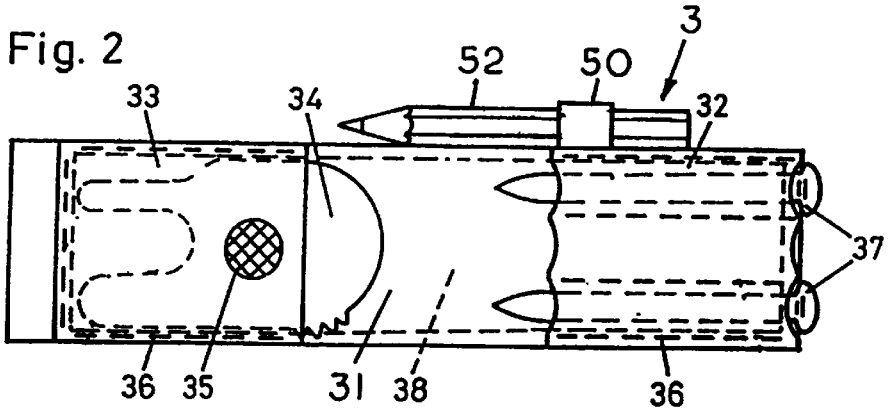
FIG. 2 is a front plan view of a carrying element of the present invention.
Figure 3:
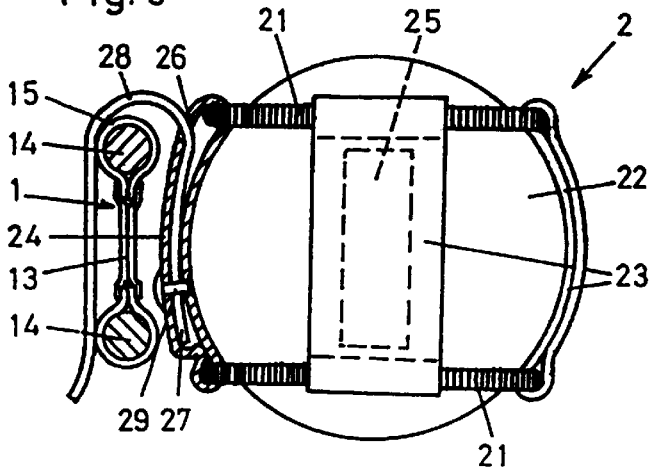
FIG. 3 is a partial cross-sectional side view of a ball holder of the present invention removeably attached to a belt.

As seen in FIGS. 1, 2, and 3, the present invention comprises a waist belt 1, a ball holder 2, and a carrying element 3. Belt 1 is preferably similar to a standard belt that is capable of being threaded through belt loops in most pants and shorts. The dimensions of belt 1 and its appearance are similar to belts that are commonly worn by golfers when they are playing golf. Belt 1 is preferably an attractive design to visually enhance the user's appearance. Belt 1 may comprise a central leather strap 13 and outer edges 15. Edges 15 may be provided to visually enhance the appearance of the belt and provide an edge that is comfortable to the user. As seen in FIG. 3, edges 15 may have a cord or cushioning material 14 for providing a desired shape and cushioning. A buckle 11 is provided at one end of the belt and holes 12 are provided at the opposite end of the belt. A hook and loop fastening material 16 may be provided on belt 1 for attaching carrying element 3. Material 16 may be formed in a shape that is decorative to enhance appearance of belt 1.

Turning to FIG. 2, carrying element 3 comprises a base portion 31 and pocket portions 32 and 33 that are attached to the base portion by stitching 36. Pocket portion 32 may provide one or more pockets for golf tees 37 or other golf instruments. In the present invention golf tees 37 are preferably held in a horizontal position wherein the longitudinal axis of the golf tee is parallel to the longitudinal axis of belt 1 when carrying element 3 is attached to the belt. Unlike prior art equipment holders, the design of the present invention prevents golf tees 37 from poking the user. In this way, the present invention is less likely to distract and irritate the user and interfere with the user's swing.

Pocket portion 33 comprises a pocket for holding a divot repair tool 34. Similar to pocket 32, pocket 33 holds divot repair tool 34 so that its longitudinal access is parallel to the longitudinal access of belt 1 when carrier element 3 is attached to the belt. This also prevents the sharp edges of the divot repair tool 34 from poking the user and interfering with the user's swing. Marker 35, such as a snap button, may also be provided on base portion 31, pocket portion 32, or pocket portion 33. Hook and loop fastening material 38 may be attached to the rear side of base portion 31 for mating with hook and loop fastening material 16 of belt 1.

An important advantage of the present invention is that the average vertical height of carrying element 3 is substantially equal to or less than the vertical height of belt 1. Unlike prior art equipment holders that are vertically taller than the belts they are used with, the present invention does not poke the user with sharp edges when the user swings a golf club or bends down to pick up an object, such as a golf ball. This is not only more comfortable to the user but it is also less distracting.

An alternative embodiment of the present invention may include a pencil holder 50 for holding a pencil 52. Holder 50 is preferably a loop of elastic material sewn to base portion 31 or between base portion 31 and one of the pocket portions 32 or 33. Preferably, holder 50 extends from the upper or lower edge of carrying element 3. The configuration of holder 50 allows pencil 52 to be carried so that its longitudinal axis is parallel to the longitudinal axis of belt 1 when carrying element 3 is attached to belt 1. This prevents pencil 52 from pocking the user when the user swings or bends. If holder 50 is made from elastic material, it is able to yield to the user's body so as to further reduce the chance of interfering with the user. Carrying element 3 may have an overall vertical height with holder 50 that is substantially equal to or less than the vertical height of belt 1 when the belt is worn by a user.

In yet another embodiment, a pencil holding pocket (not shown) may be provided on one of the pocket portions 32 or 33. For example, a pencil pocket may be provided between tees 37 on pocket portion 32.

Referring now to FIG. 3, ball holder 2 of the present invention preferably comprises at least one helical spring 21 that is formed into an elastic ring. Helical springs 21 may be any of a large variety of springs that are well known in the art. Preferably, helical springs 21 are tightly wound metal springs. The inner diameters of springs 21 in an untensioned state are smaller than a diameter of a ball 22 so that ball 22 is prevented from falling out of ball holder 2. Alternatively, holder 2 may have only one elastic ring, allowing ball 22 to be inserted and removed from only one end of holder 2. A rigid ring or a concave structure may take the place of one of the helical springs.

Figure 4:
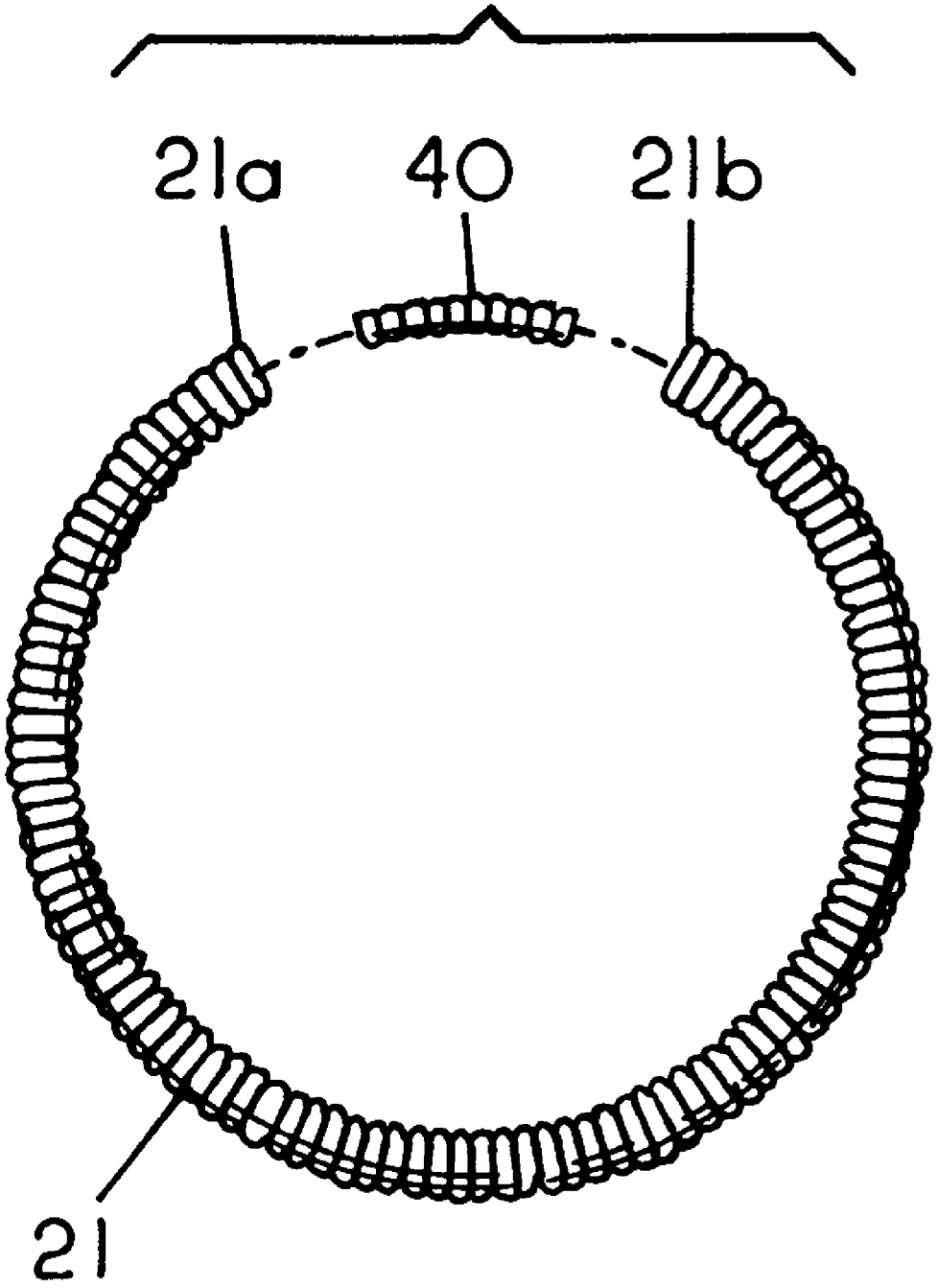
FIG. 4 is an exploded top plan view of a helical spring of the ball holder of the present invention.

As seen in FIG. 4, spring 21 may be formed into a ring by inserting or threading spring 40 into ends 21*a* and 21*b*. Spring 40 may also be a helical spring with a diameter that is smaller than spring 21. Ends 21*a* and 21*b* may also be attached together by other methods and devices that are well known in the art, such as splicing, welding, or soldering.

Returning to FIG. 3, springs 21 are attached together by at least one strap 23. Straps 23 hold springs 21 a preferred distance apart and provide structural support. Straps 23 may be stiffened by stiffening members 25 that are attached to straps 23. Preferably, straps 23 have two layers and stiffening member 25 is secured between the two layers. Stiffening number 25 may be made of any suitable material, such as metal, plastic, foam or leather.

A U-shaped clip 28 may be attached to ball holder 2 to secure the ball holder to belt 1. An end 27 of clip 28 may be inserted through a slit 26 in strap 24. A rivet 29 may be used to secure clip 28 to strap 24. Clip 28 may be made of any suitable material, such as metal or plastic.

Another advantage of the present invention is that the equipment holders are firmly attached to belt 1 so that relative motion between the user and the equipment is substantially eliminated. If equipment is allowed to move relative to the user, the user may be distracted and user's swing may be thrown off.

Yet another advantage of the present invention is that equipment is held as close to the user's center of mass as possible. As discussed earlier, the swing is the most important aspect of the game of golf Yet, a golfer's swing can be sensitive to subtle variations in weight distribution. Equipment held far from the golfer's center of mass can adversely affect the golfer's swing by disturbing the golfer's balance. The present invention minimizes this problem by holding equipment as close as possible to the user's center of mass.

In normal operation, belt 1 may be worn by a user just as other commonly used standard belts. When the user begins to play a round of golf, the user may attach ball holder 2 and carrying element 3. Instruments used while golfing are readily at hand and the user need not take time to retrieve these instruments from a golf bag or golf cart. The golfer need use one hand to remove instruments from the belt; either the left or right hand may be used.

Each of the instruments carried by ball holder 2 and carrying element 3 may be easily removed and replaced. For example, golf ball 22 may be removed from ball holder 2 by exerting a downward pressure on the top of the golf ball. The downward pressure forces lower spring 21 to expand outward and the ball may be pushed through the spring. The user may insert ball 22 into holder 2 by placing the ball on top of upper spring 21. User then exerts a downward force that squeezes ball 22 through the spring. Because springs 21 form elastic rings, golf ball 22 is held firmly in place with little or no relative motion when the user is walking or swinging a golf club. Once the user has completed a round of golf, the user may easily remove ball holder 2 and carrying element 3. Unlike prior art devices, it is not necessary to remove the belt from the user's clothes to remove the equipment holders. Belt 1 then appears to be a standard belt that can be worn while the user socializes in restaurants, bars, or other locations.

SUMMARY

It may now be seen that the present invention provides a novel multi-use belt and ball holder. The belt may be used during sporting activities as well as in social environments. A carrying element and a ball holder may be attached to the belt. The carrying element may carry a number of sports instruments, such as golf tees, a divot repair tool, and a marker. The carrying element is substantially no taller than the belt and the instruments are carried in a horizontal position so that the user is not poked by the carrying element or the instruments. The ball holder comprises at least one elastic ring that is formed of a helical spring. Both the carrying element and the ball holder to hold objects close to the user's center of mass and the objects are firmly held so that there is little or no relative motion between the objects and the user.

Although the description above contains many specifications, these should not be construed as limiting the scope of the invention but as merely providing illustrations of some of presently preferred embodiments of this invention. Thus, the scope of the invention should be determined by the appended claims and their legal equivalents rather than by the examples given.

What is claimed is:

1. A ball holder for holding a ball during a sporting activity, comprising:

(A) at least one elastic ring, the elastic ring being adapted to abut the ball, the elastic ring comprising a helical spring having two ends, the ends of the spring being joined to form the elastic ring, wherein an inner diameter of the elastic ring in an un-tensioned state is smaller than a diameter of the ball;

(B) a holding structure, said structure being adapted to abut the ball in opposition to the elastic ring, wherein the ball is held between the elastic ring and the holding structure;

(C) at least one strap, the strap being adapted to hold the elastic ring and the holding structure a predetermined distance from each other; and (D) an attachment device attached to the elastic ring the holding structure, or the strap, the attachment device being adapted to attach the ball holder to a person.

2. The ball holder of claim 1 wherein the holding structure comprises a second elastic ring.

3. The ball holder of claim 2 wherein the second elastic ring comprises a helical spring.

4. The ball holder of claim 1 wherein the holding structure comprises a rigid ring.

5. The ball holder of claim 1 wherein the holding structure comprises a concave structure.

6. The ball holder of claim 1 wherein the strap comprises a stiffener, the stiffener being adapted to provide structural rigidity to the strap.

7. The ball holder of claim 1 wherein the attachment device is a U-shaped clip.

8. The ball holder of claim 1 wherein the elastic ring comprises a second spring, the second spring being adapted to attach the ends of the elastic ring.

9. The ball holder of claim 8 wherein the second spring is adapted to be threaded into the ends of the helical spring thereby attaching the ends of the helical spring.

10. The ball holder of claim 9 wherein the second spring comprises an outer diameter and the helical spring comprises an inner diameter, wherein the outer diameter of the second spring is smaller than the inner diameter of the helical spring.

11. A method of carrying a ball on a person, the method comprising the following:

(A) providing a ball holder, the ball holder comprising:

(a) at least one elastic ring, the elastic ring being adapted to abut the ball, the elastic ring comprising a helical spring having two ends, the ends of the spring being joined to form the elastic ring, wherein an inner diameter of the elastic ring in an un-tensioned state is smaller than a diameter of the ball;

(b) a holding structure, said structure being adapted to abut the ball in opposition to the elastic ring, wherein the ball is held between the elastic ring and the holding structure; and (c) at least one strap, the strap being adapted to hold the elastic ring and the holding structure a predetermined distance from each other;

(B) attaching the ball holder to the person; and (C) inserting a ball between the elastic ring and the holding structure of the ball holder.

12. The method of claim 11 wherein the step of inserting the ball between the elastic ring and the holding structure comprises inserting the ball through the elastic ring.

13. The method of claim 11 wherein the step of inserting the ball between the elastic ring and the holding structure comprises:

(A) seating the ball on the elastic ring; and (B) pressing the ball inwards, wherein the elastic ring stretches allowing the ball to pass through the elastic ring.

* * * * *